US006908370B1

(12) United States Patent
Jiang et al.

(10) Patent No.: US 6,908,370 B1
(45) Date of Patent: Jun. 21, 2005

(54) RINSE APPARATUS AND METHOD FOR WAFER POLISHER

(75) Inventors: Lei Jiang, Camas, WA (US); Jin Liu, Albuquerque, NM (US); Sadasivan Shankar, Cupertino, CA (US); Thomas Bramblett, Banks, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/728,550

(22) Filed: Dec. 4, 2003

(51) Int. Cl.[7] ..... B24B 1/00
(52) U.S. Cl. ..... 451/60; 451/444; 451/446
(58) Field of Search ..... 451/60, 56, 41, 451/446, 444, 447, 443, 36, 37

(56) References Cited

U.S. PATENT DOCUMENTS 6,139,406 A * 10/2000 Kennedy et al. ..... 451/67
6,283,840 B1 * 9/2001 Huey ..... 451/288
6,350,183 B2 * 2/2002 Manfredi ..... 451/56
6,443,816 B2 * 9/2002 Inoue et al. ..... 451/56

* cited by examiner

*Primary Examiner*—Dung Van Nguyen
(74) *Attorney, Agent, or Firm*—Schwabe, Williamson & Wyatt, P.C.

(57) ABSTRACT

An apparatus for polishing a wafer comprising a rotatable polishing pad having a center of rotation and a rinse delivery conduit positioned adjacent to the polishing pad and substantially in radial alignment with the center. The rinse delivery conduit includes a plurality of nozzles to dispense a rinsing liquid. In one embodiment, the plurality of nozzles are configured and positioned to generate a higher flow rate of the rinsing liquid at the end of the rinse delivery conduit proximate to the center than at the end of the rinse delivery conduit distal to the center. In another embodiment, the rinse delivery conduit has a proximal end which is substantially adjacent the center and the distal end which is approximately adjacent an outer periphery of the pad.

30 Claims, 5 Drawing Sheets

RINSE APPARATUS AND METHOD FOR WAFER POLISHER

BACKGROUND OF THE INVENTION

1. Field of the Invention

The present invention relates to manufacturing devices, and in particular, to devices for polishing semiconductor wafers or substrates.

2. Description of Related Art

Chemical-mechanical polishing (CMP) is a well-known process in the semiconductor industry used to remove and planarize layers of material deposited on a semiconductor wafer or substrate to achieve a planar topography on the surface of the semiconductor wafer. To accomplish this, CMP typically involves wetting a rotatable polishing pad with a chemical slurry containing abrasive components and mechanically polishing the front surface of the wafer against the wetted pad. The pad is mounted on a rotary platen and a rotatable wafer carrier is used to apply a downward pressure against the backside of wafer. The polishing slurry is dispensed onto pad through a slurry dispensing arm during polishing. The force between the carrier and the pad and their relative rotation, in combination with the mechanical abrasion and chemical effects of the slurry, serve to polish the wafer surface.

Currently in a typical CMP, a high-pressure rinse (HPR) is applied by the slurry dispensing arm to the pad between wafer polishes, to remove pad debris, slurry residues, and foreign particles (loose conditioner tips, etc.). However, the slurry dispensing arm, which houses a high-pressure rinse delivery conduit, does not extend radially inward far enough toward the center of the pad on a 300 mm polisher. This leaves a significant amount of pad surface at its, center with less coverage by the rinse system.

With reference to FIG. 1, a portion of a prior art chemical-mechanical polisher is shown. A pad 10 has slurry dispensing arm 12, which is orientated to be radially aligned with a center 14 of the pad 10. In a normal rinsing operation, the rotating pad 10 rotates under the stationary slurry dispensing arm 12 about center 14 at a constant angular speed. As shown by the curvilinear arrows 18 of increasing length, the velocity of a given reference point on the pad 10 increases as its distance from the center 14 increases. With reference to FIG. 2, the prior art slurry dispensing arm 12 is shown in detail. The arm 12 includes a high pressure delivery conduit 20 having a plurality of equally spaced rinse nozzles 22, with each nozzle having the same diameter.

There are at least two problems with the prior art design of FIGS. 1 and 2. First, the rotary platen (not shown) motion generates lower velocities at the inner radii of the pad 10, leading to slower particle motion towards the periphery of the pad 10, thus reducing the effectiveness of the rinsing flow. Second, a tip 16 of the slurry dispensing arm 12 is typically spaced-apart from the center 14 by approximately 4–6 inch distance, with FIG. 1 showing a 6 inch distance. Scratch data and associated model analysis show that the defects causing severe scratches are located inside or near the 6" radius on the pad 10. This radius is approximately the location of the slurry arm tip 16, inside which the HRP coverage is not sufficient.

DETAILED DESCRIPTION OF AN ILLUSTRATIVE EMBODIMENT

In the following description, for purposes of explanation, numerous details are set forth in order to provide a thorough understanding of the disclosed embodiments of the present invention. However, it will be apparent to one skilled in the art that these specific details are not required in order to practice the disclosed embodiments of the present invention. In other instances, well-known electrical structures and circuits are shown in block diagram form in order not to obscure the disclosed embodiments of the present invention.

Figure 3:
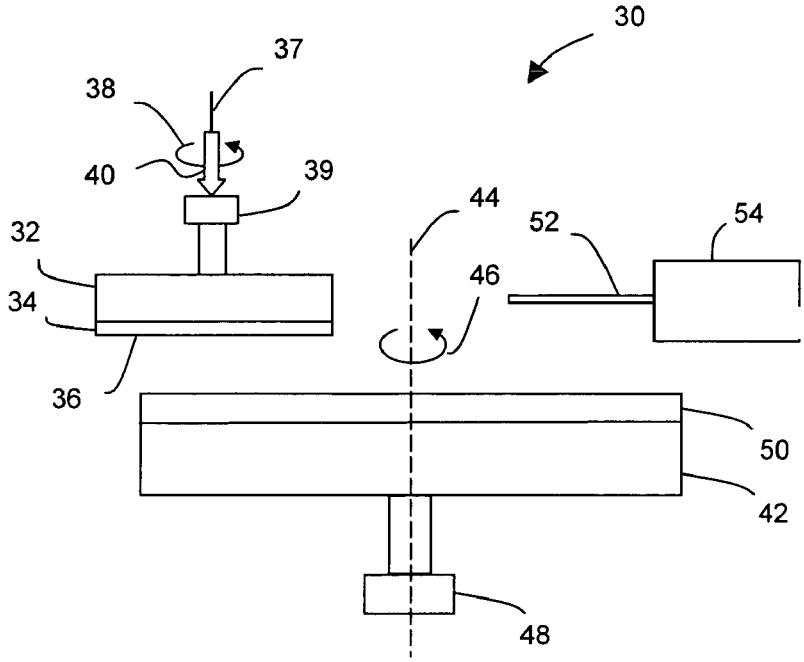
FIG. 3 is a diagram of a side view of a chemical-mechanical polisher in accordance to one embodiment of the present invention.

With reference to FIG. 3, there is illustrated a chemical-mechanical polisher 30 in accordance to one embodiment of the present invention. The polisher 30 includes a wafer carrier 32 for holding a semiconductor wafer 34 (e.g., 300 mm diameter) having a surface 36 to be polished. The wafer carrier 32 is mounted for continuous rotation about an axis 37 in a direction indicated by arrow 38 via a drive motor 39 operatively connected to the wafer carrier 32. The wafer carrier 32 is adapted so that a force indicated by arrow 40 is exerted on semiconductor wafer 34. The polisher 30 also includes a polishing platen 42 mounted for continuous rotation about an axis 44 in a direction indicated by an arrow 46 by a drive motor 48 operatively connected to the polishing platen 42. A polishing pad 50 is mounted to polishing platen 42. A polishing slurry containing an abrasive fluid is dispensed onto polishing pad 50 through a slurry dispensing arm 52 from temperature controlled reservoir 54. The slurry dispensing arm 52 is positioned adjacent to and above the polishing pad 50 and may be aligned radially with center of rotation of the polishing pad 50, which is centered on the axis 44. In other words, the longitudinal axis of the arm 52 may approximately intercept the axis 44. The polishing slurry is dispensed onto polishing pad 50 through the arm 52 from temperature controlled reservoir 54 as the wafer carrier 32 and polishing platen 42 rotate about their respective axes 37 and 44, with the slurry arm 52 remaining fix in location. The force between the polishing platen 42 and the wafer carrier 32 and their relative rotation, in combination with the mechanical abrasion and chemical effects of the slurry, serve to polish wafer surface 36.

A high-pressure rinse (HPR) is applied by the slurry dispensing arm 52 to the pad 50 between wafer polishes to remove pad debris, slurry residues, and foreign particles (loose conditioner tips, etc.). The arm 52 includes inside its walls a rinse delivery conduit (not shown) for dispensing a high pressure rinse under high-pressure conditions (for example, 40–70 psi). A plurality of radially aligned nozzles (not shown) are mounted along the delivery conduit and extend downwardly from the arm 52 to provide a rinsing liquid jet that impinges on the surface of the pad 50 before and after each wafer polish. The slurry dispensing arm 52 houses not just the high-pressure rinse delivery conduit, but also slurry line (not shown) and other water lines (not shown).

Figure 1:
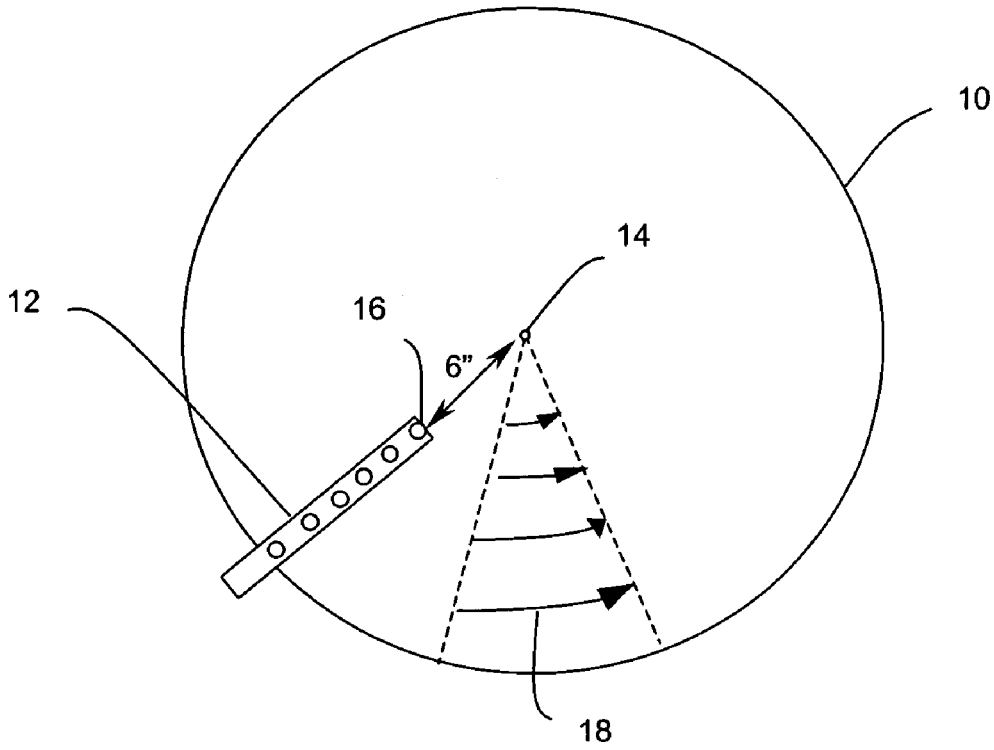
FIG. 1 (PRIOR ART)
FIG. 1 is a planar top view of a portion of a prior art chemical-mechanical polisher.
Figure 2:
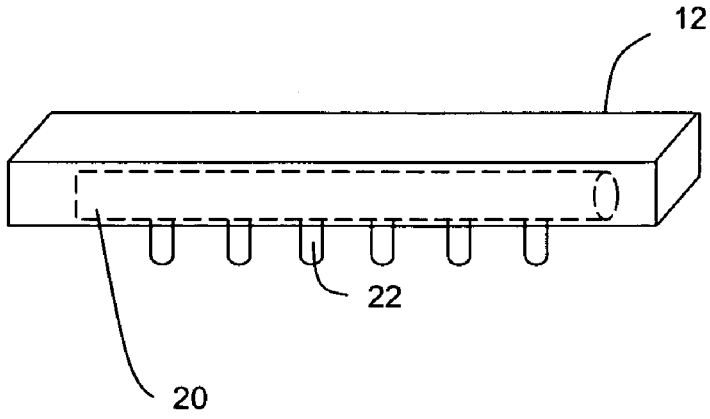
FIG. 2 (PRIOR ART)
FIG. 2 is a perspective view of a prior art slurry dispensing arm of the polisher shown in FIG. 1.

Three embodiments (first, second and third embodiments) of the rinse delivery conduit are described hereinafter with respect to FIGS. 4–7. The rinse delivery conduit has a proximate end and a distal end relative to the center of the pad. As compared to the prior art embodiment of FIG. 1, these embodiments of the rinse delivery conduit have in common the achievement of a higher flow rate or flux (ml/min) at the proximate end of the rinse delivery conduit relative to the distal end, in order to compensate for the smaller pad velocities at inner radii of the inner circular regions of the pad 50. In other words, although the pad 50 may rotate at a constant angular speed, the velocity of pad 50 beneath a point of reference on the slurry dispensing arm 52 is decreased in proportion to the decrease in the distance between the reference point and the center 44 of the pad 50. This higher flow rate of the rinsing liquid is accomplished with optimized nozzle placement and inner diameter, as will be described hereinafter. Also, with respect to units of measure along the delivery conduit, e.g., inches, the flow rate/in at the proximate end is greater than the flow rate/in at the distal end.

Figure 4:
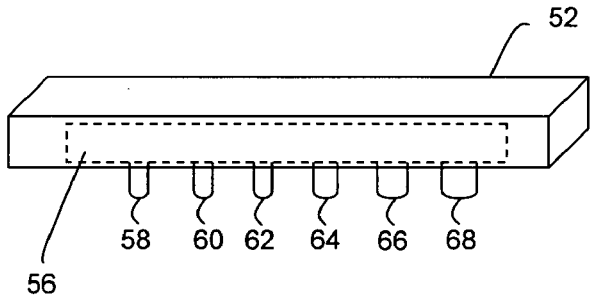
FIG. 4 is a perspective view of a first embodiment of a rinse delivery conduit contained within the slurry dispensing arm shown in FIG. 3.

Referring to FIG. 4, a first embodiment of the rinse delivery conduit, identified by reference numeral 56, is shown contained within the slurry dispensing arm 52 of FIG. 3. The rinse delivery conduit 56 extends along the longitudinal dimensions of the slurry dispensing arm 52. As previously mentioned, the arm 52 may be substantially radially located relative to the center of the pad (shown in FIG. 3). The delivery conduit 56 has a plurality of equally spaced-apart rinse nozzles 58 through 68 extending vertically downward from the bottom of the arm 52 toward the pad, with each successive nozzle along the longitudinal axis of the delivery conduit 56 in the direction of the center of the pad having successively larger inner aperture diameters for the flow of the rinsing liquid. In this embodiment, six rinse nozzles are shown, but a greater or lesser number of nozzles may be used. Likewise, although each successive nozzle is shown with a larger diameter, two or more successive nozzles may have the same diameter and still achieve some desirable results, as long as some of the nozzles proximally located to the pad's center have larger diameters than some of those distally located to the pad's center.

Figure 5:
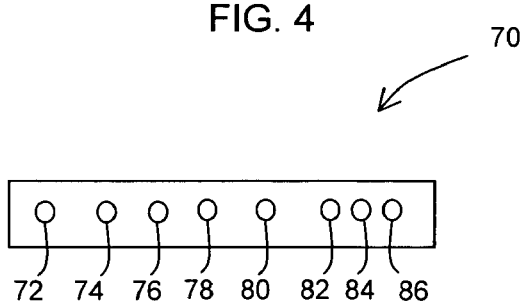
FIG. 5 is a planar bottom view of a second embodiment of the rinse delivery conduit contained within the slurry dispensing arm shown in FIG. 3.

FIG. 5 illustrates the second embodiment of the rinse delivery conduit, which is identified by reference numeral 70. As an alternative to increasing the diameters of the apertures of the nozzles as undertaken in the first embodiment, the diameters of the nozzles may remain the same, while a tighter nozzle pitch may be implemented towards the end of the delivery conduit 70. In the embodiment of FIG. 5, the spacing between nozzles 72 through 82 is substantially the same, whereas the spacing between nozzles 82 and 84 and the spacing between nozzles 84 and 86 approximately are reduced by half relative to the spacing between the first five nozzles. Other degrees spacing reduction may be used and differing numbers of nozzles may be involved with the spacing reduction. As with the first embodiment, the design for the rinse delivery conduit 70 achieves a higher rinsing flow rate or flux at the proximate end of the delivery conduit 70 in order to compensate for the smaller pad velocities for inner pad radii. Combinations of larger diameter nozzles with tighter novel pitch may be used, thereby merging the teachings of the first and second embodiments.

Figure 6:
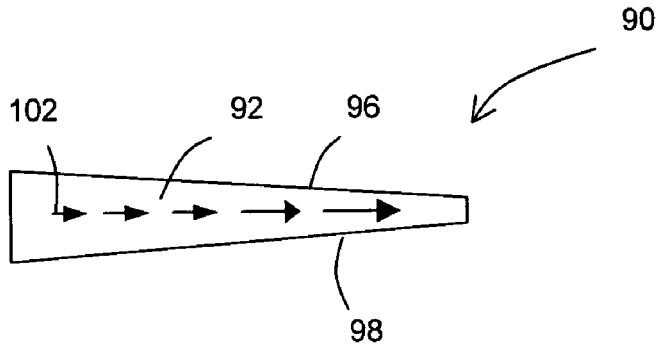
FIG. 6 is a planar top view of a third embodiment of the rinse delivery conduit contained within the slurry dispensing arm shown in FIG. 3.
Figure 7:
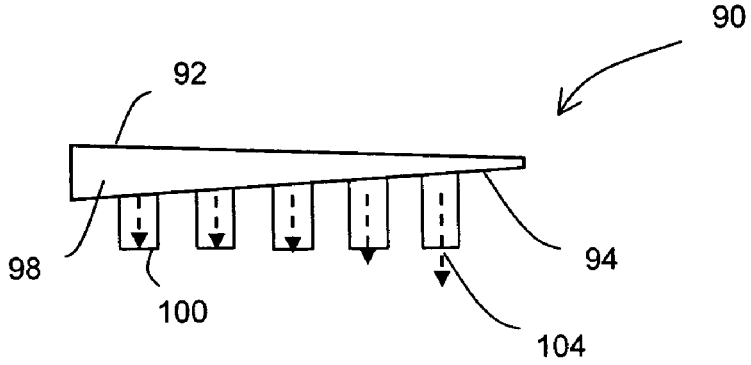
FIG. 7 is a planar side view of the third embodiment of the rinse delivery conduit shown in FIG. 6.

FIGS. 6 and 7 illustrate a third embodiment of the rinse delivery conduit, which is identified by reference numeral 90. As with the first two embodiments, the delivery conduit 90 is mounted inside the slurry dispensing arm (not depicted). The delivery conduit 90 has a top surface 92 and a bottom surface 94 which have opposed edges tapered along the longitudinal axis of the delivery conduit 90 in the direction of the center of the pad (not shown). Likewise, the delivery conduit 90 has a pair of opposed lateral sides 96 and 98 which are tapered along the longitudinal axis of the delivery conduit 90 in the direction of the center of the pad. Hence, in this embodiment the cross-sectional, interior area for the rinsing liquid, taken with reference to radial movement toward the center of the pad, decreases in two dimensions. Decreasing the cross-sectional area of the delivery conduit in one dimension (one pair of opposed sides being tapered) may also be implemented. In this embodiment, the aperture diameters of the nozzles 100 may be the same. The reduced cross sectional area of the fluid chamber inside of the delivery conduit 90 increases the local flow velocity inside the conduit, thus increasing the jet speed at the end of the conduit 90. The magnitudes of the flow velocity vectors 102 in FIG. 6 illustrate the progressively increasing flow speed along the length of the conduit 90. Likewise, the arrows 104 of FIG. 7 show that in addition to the increase flow rate toward the proximate end, the jet velocities of the rinsing liquid also increase with each successive nozzle 100. The teachings of the first two embodiments (changing nozzle spacing and aperture size) may be incorporated into this third embodiment.

With respect to the third embodiment of the rinse delivery conduit, the efficiency of such tapering geometry depends on the pressure of the HRP and generally this design is only effective at laminar flow conditions. Consequently, at high flow rates on the pad, the nozzle spacing and its diameter along the length of the rinse delivery conduit may be optimized to increase flow rate for the inner regions of the polishing pad. In essence, either doubling number of nozzles at the end of the delivery conduit or double the nozzle cross-section area at the end of the delivery conduit, or both increases the rinse flow rate on the pad by at least double near the inner pad radius at the tip of the rinse delivery conduit.

Figure 8:
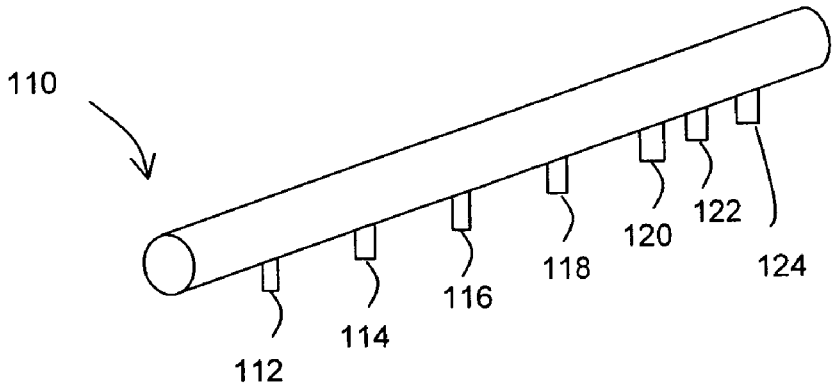
FIG. 8 is a perspective view of a first embodiment of an extended rinse delivery conduit.

Referring to FIG. 3, each of the three embodiments of the delivery conduit shown in FIGS. 4–8 may be modified to extend the length of the rinse delivery conduit. More specifically, the length of the delivery conduits may be extended in length radially toward the center or center axis 44 of the pad 50 to provide coverage of substantially the entire surface of the pad 50 and thereby compensate for the 4–6 inch gap in HPR coverage found in the prior art designs. In other words, the distal end of the delivery conduit may remain similarly located at the outer periphery of the pad 50, but the proximate end of the delivery conduit is extended to be adjacent to the center of the pad 50. This extension modification may be used in those polishers where the entire slurry dispensing arm may be extended to the pad center 44 without impacting the tool configuration (head motion, etc.)

and throughput of the tool. As an illustrative example, FIG. 8 shows a lengthened delivery conduit 110, which has a plurality of nozzles 112–124. The spacing between the nozzles 120 and 122 and nozzles 122 and 124 is half that of the spacing at the beginning of the delivery conduit 110. The conduit 110 is of a similar design as that shown in FIG. 5, except it is extended in length. More specifically, in this example, the 200 mm conduit of the second embodiment of FIG. 5 is extended to 250 mm in total length in the embodiment of FIG. 8. The nozzle pitch shrinks along the length of the delivery conduit 110 from 40 mm (between nozzles 112–120 to 20 mm (between nozzles 120–124) in this example. As an example of other variations, the cross-sectional areas of internal nozzle apertures for the nozzles 120–124 are doubled. Similar extensions in length of the rinse delivery conduits may be undertaken for the first embodiment shown in FIG. 4 and the third embodiment shown in FIGS. 6 and 7.

Figure 9:
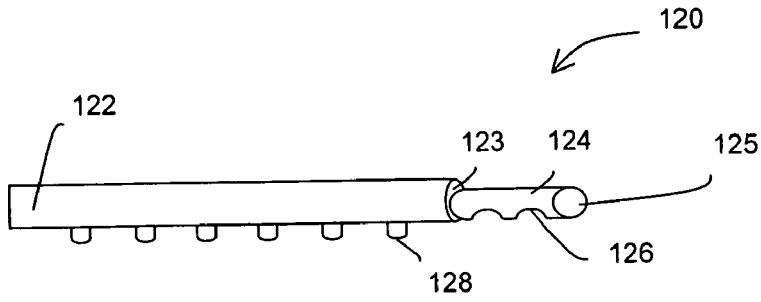
FIG. 9 is a perspective view of a second embodiment of the extended rinse delivery conduit.
Figure 10:
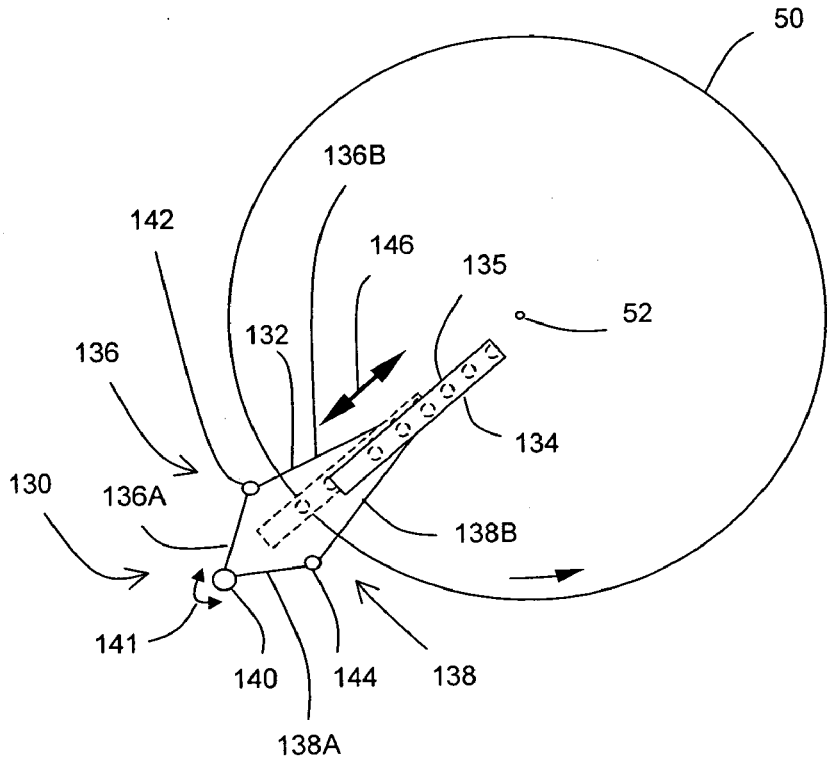
FIG. 10 is a top view of a third embodiment of the extended rinse delivery conduit.

In those polishers where there is a physical limit to the slurry arm within the tool design, two modifications may be made to enable an axial sweeping motion of the high-pressure rinse delivery conduit as shown in the embodiments of FIGS. 9 and 10. With reference to FIG. 3, the two embodiments of FIGS. 9 and 10 modify the rinse delivery conduit to extend it inward toward the center axis 44 of the pad 50, so as to provide coverage of the entire surface of the pad 50 and thereby compensate for the 4–6 inch gap in HPR coverage found in the prior art design of FIG. 1. In both embodiments the rinse delivery has a "retracted position" and an "extended position", with the center portion of the pad 50 having HPR coverage when the rinse delivery conduit is in its extended position.

Referring to FIG. 9, a rinse delivery conduit 120 includes an outer conduit 122 having an open end 123 facing the pad's center (not depicted) and an inner conduit 124 having an open end (not show) positioned within the outer conduit 122 and a closed end 125 facing the pad's center. The inner conduit 122 is configured and dimensioned for sliding engagement with the interior wall of the outer conduit 122, so as to move from the "retracted position" wherein the inner conduit 124 is contained within the outer conduit 122 to the "extended position" wherein the inner conduit 124 extends outward from the outer conduit 122. The inner conduit 124 has a plurality of apertures 126 which are exposed when in the extended position and the outer conduit 122 has a plurality of nozzles 128. When in its extended position, the outer conduit 122 provides the rinsing liquid through its nozzles 128 and the inner conduit 124 provides rinsing liquid through its apertures 126. The outer conduit 122 is mounted to the slurry dispensing arm (not shown) in the same manner as illustrated in FIG. 4. The inner conduit 124 is in its extended position only when a high-enough pressure is applied by the rinsing liquid; otherwise, it is in its retracted position. When in its extended position, the inner conduit 124 may extend inwardly approximately to the center of the pad (not shown). The rinse delivery conduit 120 enables coverage of the pad center area (not shown) when there is no wafer being polished. Therefore, the inner conduit 124 does not collide with the polish head or other apparatus on the platen which are positioned over the pad's center when the wafer is being polished.

Referring to FIG. 10, a slurry dispensing arm assembly 130 is mounted for radial extension toward and retraction away from the center 52 of the pad 50. An extension mechanism 132 is coupled to the slurry dispensing arm 134, which is activated only during a high-pressure rinse stage. The slurry dispensing arm 134 within its interior includes a delivery conduit (not shown) with nozzles 135. The extension mechanism 132 includes a pair of extension arms 136 and 138, with the distal ends thereof pivotally mounted at a rotary actuator 140. The proximate ends of extension arms 136 and 138 are pivotally mounted to opposed sides of the slurry dispensing arm 134. The extension arms 136 and 138 include revolving joints 142 and 144, which respectively divide the extension arm 136 into a first arm portion 136A and a second arm portion 136B and the second extension arm 138 into a first arm portion 138A and a second arm portion 138B. The two revolving joints 142 and 144 ensure the radial motion of the slurry dispensing arm 134, and the rotary actuator 140 at the based of the extension mechanism 132 may control the radial sweep amplitude. The arrow 141 shows the rotation of the arm portions 136A and 138A about the pivotal axis of the rotary actuator 140, which in turn extends the slurry dispensing arm 134 when the arm portions are pivoted toward each other and retracts the slurry dispensing arm 134 when the two arm portions are pivoted apart from each other. This is a simple mechanism to control and program, and may be either applied to the entire slurry dispensing arm 134 as shown in FIG. 10, or dedicated to the high-pressure delivery conduit only. The slurry dispensing arm 134 radially extends and retracts as shown by arrow 146, with the slurry dispensing arm 134 being shown with dashed lines when in its retracted position and in solid lines when in its extended position.

Typical pressure condition of the rinse delivery nozzle may be approximately 60 psi. The dimensions of the nozzle, without enlargement as in FIG. 4, may typically be a 10 mm tube diameter and 3 mm nozzle diameter. Although the rinse delivery conduit is shown in the various embodiments with a circular cross section, other cross-sectional configurations may be used. Additionally, although the nozzles are shown to be radially aligned along a radius line extending from the center of the pad, the alignment of the nozzles may substantially deviate from a straight line and be considered to be "substantially in radially alignment", with such term intended to define a relationship of each successive nozzle having a smaller distance (radius) to the pad's center.

Figure 11:
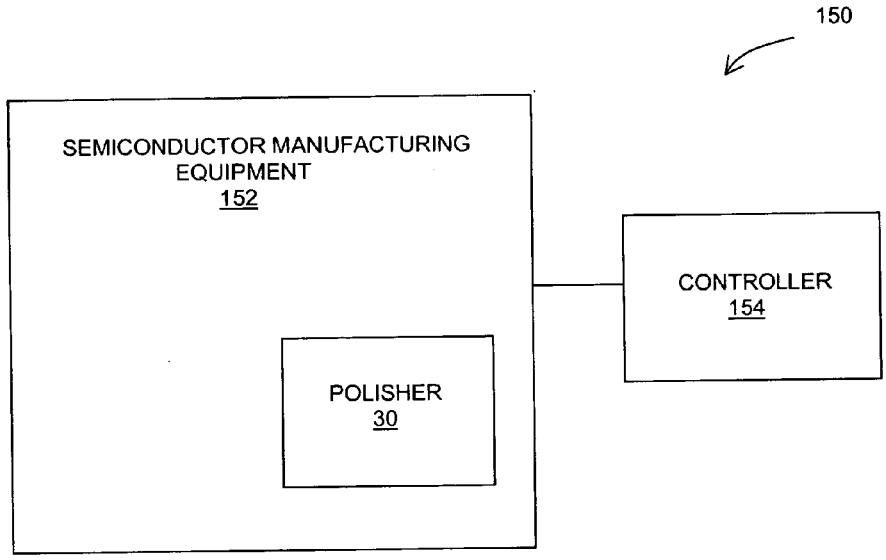
FIG. 11 is a diagram of a system including the polisher of FIG. 3.

FIG. 11 is a block diagram representation of a semiconductor manufacturing system 150, typically found in a semiconductor manufacturing facility, for processing semiconductor wafers to produce any number of semiconductor products, such as DRAMs, processors, etc. The system 150 includes semiconductor manufacturing equipment 152 having a plurality of modules, such as physical vapor deposition (PVD) modules, copper wiring modules, dep-etch modules, and the like. Thus, wafers are passed from one module to another where any number of operations may be performed, the ultimate goal of which is to arrive at a final integrated circuit product. Each module may include any number of tools to process wafers, with at least one of the tools being the chemical-mechanical polisher 30 in accordance to one embodiment of the present invention. Other tools may include chemical vapor deposition, etch, copper barrier seed tools, and the like. Thus, similar to the module level, wafers are passed from one tool to another where any number of operations may be performed, the ultimate goal of which is to arrive at the module final product. Control of the various modules and tools is provided by a controller 154, which steps the wafers through the fabrication process to obtain the final product.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. An apparatus for polishing a wafer, comprising:

a rotatable polishing pad having a center of rotation;

a rinse delivery conduit positioned adjacent to the polishing pad and substantially in radial alignment with the center;

the rinse delivery conduit including a plurality of nozzles to dispense a rinsing liquid; and the plurality of nozzles being configured and positioned to generate a higher flow rate of the rinsing liquid against the polishing pad at the end of the rinse delivery conduit proximate to the center than at the end of the rinse delivery conduit distal to the center.

2. The apparatus according to claim 1, wherein the rinse delivery conduit has a proximal end and a distal end, the proximal end being substantially adjacent to the center and the distal end being approximately adjacent to an outer periphery of the pad.

3. The apparatus according to claim 1, wherein at least one of the nozzles proximate to the center has a first internal diameter and at least one of the nozzles distal to the center has a second internal diameter, said first internal diameter being greater than the second internal diameter.

4. The apparatus according to claim 3, wherein the rinse delivery conduit has a proximal end and a distal end, the proximal end being substantially adjacent to the center and the distal end being approximately adjacent to an outer periphery of the pad.

5. The apparatus according to claim 1, wherein the plurality of nozzles are substantially aligned on a radius of the polishing pad extending from the center and each successive nozzle in a direction toward the center has a greater internal diameter than the previous nozzle.

6. The apparatus according to claim 5, wherein the nozzles are substantially equally spaced apart along the radius.

7. The apparatus according to claim 1, wherein each of the nozzles has a center axis which when extended intersects a surface of the polishing pad; the center axes of at least two of the nozzles proximate to the center are spaced-apart by a first distance measured along the surface of the polishing pad and the center axes of at least two of the nozzles distal to the center are spaced-apart by a second distance measured along the surface of the polishing pad, the first distance being smaller than the second distance.

8. The apparatus according to claim 7, wherein the center axes of three of the nozzles most proximate to the center are separated by the first distance and the center axes of the rest of the nozzles are separated by the second distance.

9. The apparatus according to claim 1, wherein the rinse delivery conduit has a proximal end and a distal end, the proximal end being substantially adjacent to the center and the distal end being approximately adjacent to an outer periphery of the pad; and each of the nozzles extends downwardly from the rinse delivery conduit in a substantially perpendicular relationship to the polishing pad.

10. The apparatus according to claim 1, wherein each of the nozzles is adapted to generate a jet of the rinsing liquid disposed to impinge upon a surface of the polishing pad; the jets of at least two of the nozzles proximate to the center have their respective centers spaced-apart by a first distance measured along the surface of the polishing pad and the jets of at least two of the nozzles distal to the center have their respective centers spaced-apart by a second distance measured alone the surface of the polishing pad, the first distance being smaller than the second distance.

11. The apparatus according to claim 1, wherein the rinse delivery conduit is formed by two pairs of opposed sides, at least one pair of opposed sides are tapered in the direction of the center.

12. The apparatus according to claim 11, wherein both pairs of opposed sides are tapered in the direction of the center.

13. The apparatus according to claim 12, wherein the rinse delivery conduit has a proximal end and a distal end, the proximal end being substantially adjacent to the center and the distal end being approximately adjacent to an outer periphery of the pad.

14. The apparatus according to claim 12, wherein the nozzles each have an internal diameter that is the same.

15. The apparatus according to claim 1, wherein the rinse delivery conduit is operable to move from a retracted position to an extended position to provide the rinsing liquid, with the end of the rinse delivery conduit being adjacent to the center when in the extended position.

16. The apparatus according to claim 15, wherein the rinse delivery conduit includes a first conduit having an open end facing the center and second conduit having a closed end facing the center and being disposed in a sliding relationship with the first conduit, the second conduit being in the extended position to provide the rinsing liquid and the retracted position when not providing the rinsing liquid, and the first conduit including the plurality of nozzles and the second conduit including a plurality of fluid apertures.

17. The apparatus according to claim 16, wherein the first conduit is an outer conduit and the second conduit is an inner conduit disposed in sliding relationship with an interior of the outer conduit.

18. The apparatus according to claim 15, further comprising a rotary actuator and a pair of jointed extension arms extending from opposed sides of the rinse delivery conduit to the rotary actuator, wherein the rotary actuator is operable to rotate the ends of the jointed extension arms inwardly to cause the rinse delivery conduit to move from the retracted position to the extended position.

19. The apparatus according to claim 1, further comprising a slurry dispensing arm being radially aligned above the pad and the rinse delivery conduit being mounted inside of the slurry dispensing arm.

20. A method for polishing a wafer, comprising:

rotating a polishing pad having a center of rotation;

rinsing the pad with a rinsing liquid subtantially along a fixed radial line extending from the periphery of the pad to the center of the pad while the pad is rotating; and adjusting the rinsing liquid to have at least a first flow rate at an inner region of the pad proximate to the center and at least a second flow rate at an outer region of the pad distal to the center, the first flow rate being greater than the second flow rate.

21. The method according to claim 20, wherein rinsing the pad includes providing a rinse delivery conduit having a plurality of nozzles to dispense the rinsing liquid and extending relative to the center the rinse delivery conduit from a retracted position to an extended position to dispense the rinsing liquid.

22. The method according to claim 20, wherein rinsing the pad includes providing a rinse delivery conduit including a plurality of nozzles to dispense the rinsing liquid; and adjusting the rinsing liquid includes providing at least one of the nozzles proximate to the center with a first internal diameter and at least one of the nozzles distal to the center with a second internal diameter, said first internal diameter being greater than the second internal diameter.

23. The method according to claim 20, wherein rinsing the pad includes providing a rinse delivery conduit having a plurality of nozzles to dispense the rinsing liquid, with each of the nozzles having a center axis which when extended intersects a surface of the polishing pad; and adjusting the rinsing liquid includes providing at least two of the nozzles proximate to the center with their respective center axes being spaced-apart by a first distance measured along the surface of the polishing pad and at least two of the nozzles distal to the center with their respective center axes being spaced-apart by a second distance measured alone the surface of the polishing pad, the first distance being smaller than the second distance.

24. The method according to claim 20, wherein rinsing the pad includes providing a rinse delivery conduit having a plurality of nozzles to dispense the rinsing liquid; and adjusting the rinsing liquid includes providing the rinse delivery conduit which is formed by two pairs of opposed sides, at least one pair of opposed sides are tapered in the direction of the center.

25. A system to manufacture a wafer, comprising:

a polisher including a rotatable polishing pad having a center of rotation; a rinse delivery conduit positioned adjacent to the polishing pad and substantially in radial alignment with the center; the rinse delivery conduit including a plurality of nozzles to dispense a rinsing liquid; and the plurality of nozzles being configured and positioned to generate a higher flow rate of the rinsing liquid against the polishing pad at the end of the rinse delivery conduit proximate to the center than at the end of the rinse delivery conduit distal to the center; and a controller coupled to the polisher to control the dispensing of the rinsing liquid.

26. The system according to claim 25, wherein the rinse delivery conduit has a proximal end and a distal end, the proximal end being substantially adjacent to the center and the distal end being approximately adjacent to an outer periphery of the pad; and each of the nozzles extends downwardly from the rinse delivery conduit in a substantially perpendicular relationship to the polishing pad.

27. The system according to claim 25, wherein at least one of the nozzles proximate to the center has a first internal diameter and at least one of the nozzles distal to the center has a second internal diameter, said first internal diameter being greater than the second internal diameter.

28. The system according to claim 25, wherein each of the nozzles has a center axis which when extended intersects a surface of the polishing pad; the center axes of at least two of the nozzles proximate to the center are spaced-apart by a first distance measured along the surface of the polishing pad and the center axes of at least two of the nozzles distal to the center are spaced-apart by a second distance measured along the surface of the polishing pad, the first distance being smaller than the second distance.

29. The system according to claim 25, wherein the rinse delivery conduit is formed by two pairs of opposed sides, at least one pair of opposed sides are tapered in the direction of the center.

30. The system according to claim 25, wherein the rinse delivery conduit is operable to move from a retracted position to an extended position to provide the rinsing liquid, with the end of the rinse delivery conduit being adjacent to the center when in the extended position.

* * * * *

UNITED STATES PATENT AND TRADEMARK OFFICE

CERTIFICATE OF CORRECTION

PATENT NO. : 6,908,370 B1
APPLICATION NO. : 10/728550
DATED : June 21, 2005
INVENTOR(S) : Jiang et al.

It is certified that error appears in the above-identified patent and that said Letters Patent is hereby corrected as shown below:

Col. 8, line 2, "...alone the surface..." should read --...along the surface...--;
Col. 8, line 49, "...subtantially..." should read --...substantially...; and
Col. 9, lines 15-16, "...alone the surface..." should read -- ...along the surface...--.

Signed and Sealed this

Twelfth Day of September, 2006

JON W. DUDAS
*Director of the United States Patent and Trademark Office*